United States Patent [19]

Buchien

[11] Patent Number: 4,773,155

[45] Date of Patent: Sep. 27, 1988

[54] MAT SWITCH AND PROCESS FOR ITS MANUFACTURE

[75] Inventor: Fritz Buchien, Schelklingen, Fed. Rep. of Germany

[73] Assignee: Mayser GmbH & Co., Ulm, Fed. Rep. of Germany

[21] Appl. No.: 933,523

[22] PCT Filed: Mar. 3, 1986

[86] PCT No.: PCT/DE86/00079

§ 371 Date: Nov. 5, 1986

§ 102(e) Date: Nov. 5, 1986

[87] PCT Pub. No.: WO86/05317

PCT Pub. Date: Sep. 12, 1986

[30] Foreign Application Priority Data

Mar. 6, 1985 [DE] Fed. Rep. of Germany ..... 3507922

[51] Int. Cl.[4] ..... H01H 11/04

[52] U.S. Cl. ..... 29/622; 200/86 R; 264/263; 264/511

[58] Field of Search ..... 340/666, 667; 200/5 R, 200/5 A, 292, 302.1, 302.2, 302.3, 333, 85 R, 85 A, 86 R, 86 A, 86.5, 153 C, 159 B, 275, 279; 29/622; 264/263, 511

[56] References Cited

U.S. PATENT DOCUMENTS

| | | | |
|---|---|---|---|
| 3,654,407 | 4/1972 | Kepner et al. | 200/86 R |
| 3,718,791 | 2/1973 | Szablowski | 200/86 R |
| 3,722,086 | 3/1973 | Wikkerink et al. | 29/622 |
| 3,812,313 | 5/1974 | Wolf | 200/86 R |
| 3,821,500 | 6/1974 | Newman | 200/86 R |
| 4,172,216 | 10/1979 | O'Shea | 200/86 R |

FOREIGN PATENT DOCUMENTS

| | | | |
|---|---|---|---|
| 1169001 | 4/1964 | Fed. Rep. of Germany . | |
| 72862 | 5/1972 | Fed. Rep. of Germany . | |
| 2432844 | 2/1975 | Fed. Rep. of Germany . | |
| 2418856 | 11/1975 | Fed. Rep. of Germany . | |
| 1411281 | 10/1975 | United Kingdom | 200/86 R |
| 2107933 | 5/1983 | United Kingdom . | |
| 2134714 | 8/1984 | United Kingdom . | |

OTHER PUBLICATIONS

The SAE Journal of Automotive Engineering, vol. 79, No. 10, Oct. 1971, pp. 22–23.

*Primary Examiner*—P. W. Echols
*Attorney, Agent, or Firm*—Herbert Dubno

[57] ABSTRACT

The mat switch consists of two oppositely located, mutually movable and electrically conductible contact surfaces (1, 2), separated by electrically-insulated spacers (3), elastically deformable in vertical direction with respect to the contact surfaces (1, 2) and defining contact windows (4) between them. In the area of the contact windows (4), on at least one of the contact surfaces (1, 2), there are contact bosses (5) projecting towards the opposite contact surface (1, 2), whereby the distance between the contact bosses (5) and the oppositely located contact surface (1, 2), respectively the opposite contact bosses, is not bigger than the range of spring of the spacers (3), when the mat switch is not under load. The contact bosses (5) can consist of bulges in a foil forming the contact surfaces (1, 2). For their production, after a marginal sealing of both contact surfaces (1, 2) a pressure difference is built between the inside and the outside of the mat switch, so that in the area of the contact windows (4), inwardly directed bulges of the contact surfaces (1, 2) are created, which bulges are stabilized by means of an externally applied hardenable layer with sufficient shape-preserving rigidity.

5 Claims, 2 Drawing Sheets

MAT SWITCH AND PROCESS FOR ITS MANUFACTURE

CROSS REFERENCE TO RELATED APPLICATIONS

This application is a national phase application corresponding to PCT/DE86/00079 filed 3 Mar. 1986 and based, in turn, on a German national application No. P35 07922.3 filed 6 Mar. 1985 under the International Convention.

FIELD OF THE INVENTION

The invention relates to a mat switch with two opposite, mutually movable, particularly flexible and electrically conductible contact surfaces, separated by electrically-insulated spacers, elastically deformable in vertical direction and defining contact windows between them, having projecting contact bosses in the area of the contact windows on at least one of the two contact surfaces with respect to the opposite contact surface, these bosses consisting of bulges in the contact surface, whereby the distance between these contact bosses and the opposite contact surface, e.g. the opposing contact bosses, is not greater than the elastic range of spring action of the the spacers.

BACKGROUND OF THE INVENTION

Such mat switches are used, for instance, as protection devices for closers. When an object, located in the path of contact closing edges, is in contact with the mat switch, a closed path, similar to that of a turned-on switch is established, through which a safety measure, as a rule a disconnection of the drive for the closer, can be initiated. Such mats are also used as contact floor mats within the path of the closing edges, so that the drive can not be actuated, as long as a person stands on the contact floor mat.

A mat of this kind is known from the publication "THE SAE JOURNAL OF AUTOMOTIVE ENGINEERING" Vol. 79, No. 10, Oct. 1091, page 22 and serves there as a sensor indicating whether the seat of a vehicle is occupied or not. The contact surfaces consist of thin copper sheet, and the bulges are formed therein by impression. The shape-preserving rigidity of these sheets required by the impression results however in the need for relatively high forces in order to establish contact. In addition, the acting forces have to be distributed over a relatively large surface, in order to counteract the high shape-preserving rigidity of the contact surfaces, to bring them closer to each other and establish contact between them. If the mat switch is subjected only to a local pressure, no contact may be made as a result of these forces, while when bigger forces are applied there can result a permanent deformation of the contact surface.

A similar mat switch is also known from the German open application DE-OS No. 24 18 856. However, there the bulges within the range of the contact windows are formed in the opposite direction, so that in the window area the contact surfaces are separated from each other by a greater distance than in the area of the spacers. When pressure is applied, the bulges reverse themselves elastically towards the opposite contact surface and establish the contact this way. But, even in this case, considerable forces are required, since the contact surfaces must have a sufficient shape-preserving rigidity. Also, the mat switch must be sealed in a synthetic-material sheathing, for the purpose of avoiding the penetration of dirt or water.

In the mat switch known from the German published specification DE AS No. 11 69 001, the contact surfaces are flat and parallel when not subjected to a load. The upper surface to be exposed to the load is made of heavy sheet metal, resistant to any bending, while the lower contact surface is made of relatively light sheet metal. The lower contact surface is provided at its bottom with base projections, arranged in the area of the contact windows. When the mat switch is subjected to load, the base projections push the lower contact surface upwardly, in the area of the contact windows and the contact is established. Here too, considerable forces are required in order to initiate the switching operation, because deformation of the entire lower contact surface required, due to the rigidity of the upper contact surface.

Finally, a process for manufacturing a mat switch is known from U.S. Pat. No. 3,722,086, wherein at first spacers are fastened to one plate-like contact surface and an O-ring is superimposed along the edges. A second contact plate is laid on top thereof and the inner space is evacuated through an opening. As a result, the two contact plates come to rest one against the other, between the spacers. After a polymer ribbon is wound around the two plates, they are both suspended in a mold. After that the inner space is aerated through a hollow needle, the contact plates resume their original flat shape, plane-parallel with respect to each other, which causes the enveloping mold to assume a wave-like structure on the outside.

The enveloping mold has therefore, in the area of the contact windows, a greater thickness and forms, there too, projections through which the two contact surfaces come to lie against each other. This way, the two contact surfaces have a high degree of shape-preserving rigidity also in this case, so that contact is established only when relatively high pressure forces act upon the mat switch.

These known set-ups are therefore suited only to sense such pressure forces like the ones initiated by the body weight of a person. They are, for this reason, not suited for use on strip switches which respond already to very low pressure forces, like for instance the ones used on closing devices.

OBJECT OF THE INVENTION

The invention has the object to provide an improved method of making a mat switch of the afore-mentioned kind, so that a safe contact can be established even with low pressure forces and that the danger of permanent deformation can be largely avoided, and also that it be sufficiently robust to withstand higher loads, particularly to enable the mat to be subjected to walking.

SUMMARY OF THE INVENTION

In accordance with the invention, this object is attained by forming the contact surface provided wit the contact bosses into a foil with an unstable shape, carrying on its side which faces away from the other contact surface an elastic layer stabilizing the bulges.

The improvement created by the invention resides basically in the fact that at least one of the contact surfaces has a reduced shape-preserving rigidity, so that a contact is already established even when there is only a local and very slight pressure. The provided contact bosses which also contribute to a reduction of the forces required for the deformation of the spacers to bring about the contact and which cannot be, per se, inserted into the foil in a shape-preserving manner, are durably stabilized through the elastic layer.

In a preferred embodiment of the invention, I completely cover the contact surface on the outside with the coating layer. In this way, the embedding of the mat switch in a separate cover can be dispensed with.

The two contact surfaces, separated by the spacers which form the contact windows, can at first be laterally sealed with respect to each other. After that, a pressure difference is built up between the inside and the outside of the mat switch with the inner pressure being lower than the outer pressure. Then the bulges of the contact surface, directed towards the inside by the pressure difference in the area of the contact windows, are fixed by means of an externally applied, particularly elastic hardenable layer which hardens to sufficient form rigidity, to preserve the bulges also without the pressure difference, and that finally, after the hardening of the coating layer, the pressure difference is reduced.

The special advantage of this method consists, first of all, in that for the shaping of the contact bosses no forming tools of any kind are required, so that mat switches of various sizes and with any desired arrangement of the contact bosses can be produced. Each contact boss is arranged exactly within the area (lumen) of the contact windows defined by the spacers. Due to the fact that the pressure difference is consistent throughout the mat switch, a very uniform formation of the contact bosses is insured. In each case the pressure difference is purposely so selected that the two contact surfaces are brought into touch with one another. This way, it is insured in a simple manner that the contact gap when the mat switch is not under load, and thereby the actuation force required for establishing the contact, is basically the same throughout the entire surface of the mat switch. Due to the internal pressure, which is lower than the external pressure, the contact bosses are deformed due to a basically constant force acting upon the surface. This deformation impacts upon the mutual positioning of both contact surfaces and thus also impacts upon the range of spring required for making contact after the reduction of the pressure difference.

When only one of the two contact surfaces is to be provided with bulges, the other surface can be braced with an elastic, but sufficiently rigid, or even with a stiff layer, before the build-up of the pressure difference, in order to avoid the formation of the bulges therein.

The pressure difference can be built up in a very simple manner, by evacuating the internal space of the mat switch through a channel. The marginal sealing of the two contact surfaces, required for the pressure difference built-up can be done, as a rule, with any usual sealing means. This can be done in a particularly simple manner by marginally sealing the mat switch with a first, at least marginally enveloping layer of reduced thickness. It is thereby also possible to completely cover the surface of the mat switch with a layer, when the layer is sufficiently thin, so that bulges can still be formed as a result of the difference in pressure which is generated.

SPECIFIC DESCRIPTION

Figure 1:
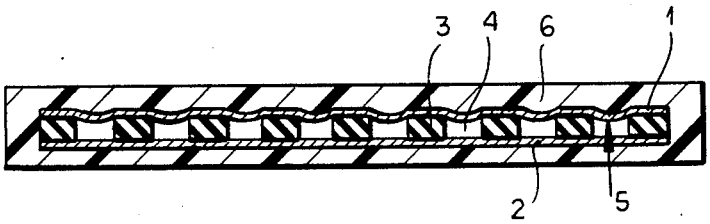
FIG. 1 is a mat switch according to the invention in a sectional view.

The mat switch represented in the drawing consists of two oppositely located, flexible and electrically conductive contact surfaces 1, 2. The contact surfaces 1, 2 are separated from each other by elastically deformable spacers 3, whereby the spacers 3 define between them the contact windows 4. Within the areas of the contact windows 4, on one of the two respective contact surfaces 1, contact bosses 5, projecting towards the opposite contact surface 2 are provided. The contact bosses 5 are dimensioned so that the distance between the contact bosses 5 and the opposite contact surface 2 is not greater than the elastic range of spring of the spacers 3, when the mat switch is not under load. There is also a possibility, which is not illustrated in the drawing, to have both contact surfaces 1, 2 equipped with contact bosses 5.

As can be seen in detail from FIG. 1, the contact surface 1 consists of a foil provided with the contact bosses 5 creating the bulges. On its other side, facing away from the contact surface 2, the foil carries an elastic layer 6, which preserves the bulges, which also covers sealingly the entire mat switch on the outside. The layer 6 can be a natural or synthetic castable mass, which for the casting process is used either in a viscous state, due to heating or addition of solvents or softeners, or is obtained through chemical reactions from initial componnents.

The coating can also be a foam, but can also be produced through sintering of pulverized raw materials, provided that the sealing is insured.

A PUR-coating, made of two or more components, has been proven to be particularly suitable.

The spacers 3 are made from a mat of foam material, which has cut-outs forming the contact windows 4. The contact windows 4 can for instance have a circular or square shape and can be punched out from the blank of foam material, whereby their mutual arrangement can be selected in such a way that the spacers 3 are reduced to narrow strips. Also, the spacers 3 can be made from strips of foam material arranged in a grate-like manner, at a distance from each other, whose intervals create the contact windows 4.

For the production of a mat switch, wherein the contact surfaces 1, 2 are made of foil, at first the two contact surfaces 1, 2, separated from each other by the spacers 3, are marginally sealed against each other. After that, a pressure difference is built between the inner space of the mat switch and the outside, whereby the internal pressure is lower than the external pressure. As a result of this pressure difference, bulges directed towards the inside of the mat switch are formed in the area of the contact windows 4, which bulges can be stabilized by means of an externally applied elastically hardening layer 6, of sufficient form rigidity, capable to maintain the shape of the bulges, even after the pressure difference has been reduced. As a rule, the pressure difference is selected so that the two contact surfaces 1, 2 are in touch with each other, since then, after the reduction of the pressure difference, the distance of the contact boss 5 from the opposite contact surface 2, respectively from the oppositely located contact boss, equals the spring deflection of the spacer 3, by which it has been elastically deformed, due to the influence of the pressure difference.

Figure 2:
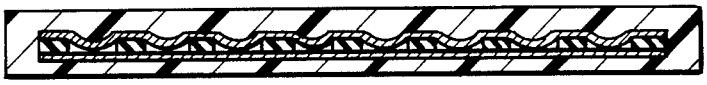
FIG. 2 is the mat switch in a view according to FIG. 1, subjected to load.

One of the two contact surfaces 1, 2 can already be provided with an elastic, but sufficiently form-rigid layer, or even with a stiff layer, before the pressure difference is built up, so that on this contact surface no bulges can appear, as represented in FIGS. 1 and 2 for the contact surface 2. The build-up of the pressure difference can be done in the simplest manner by evacuating the inner space of the mat switch through a channel, whereby as a rule a pressure difference of approximately 0.5 atmospheres suffices. The marginal sealing for the evacuation can be done in a particularly simple manner, by coating the mat switch with a layer of very reduced thickness, so that the bulges can still be formed without difficulty, during the subsequent build-up of the pressure difference.

Figure 3:
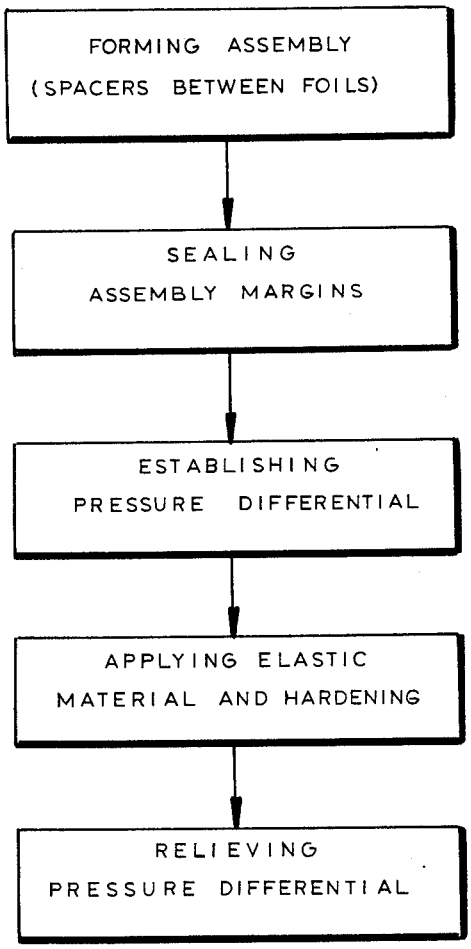
FIG. 3 is a schematic block diagram of the method steps according to the invention.

FIG. 3 summarizes the several steps for the method of making a mat switch of the present invention. As illustrated these steps include (1) forming an assembly by positioning deformable conductive foil layers on opposite sides of spacers; (2) sealing the assembly margins; (3) establishing a pressure differential having reduced internal pressure; (4) applying elastic material around assembly and hardening; and (5) relieving the pressure differential.

What is claimed is:

1. A method of making a mat switch, comprising the steps of:

(a) spacedly juxtaposing in coextensive relationship a plastically deformable metal foil with an opposing conductive surface across an elastically compressible spacer layer formed with windows to provide a sandwich assembly in which said foil and surface lie on opposite sides of said spacer layer;

(b) sealing said assembly along margins thereof;

(c) establishing between the interior of said assembly as sealed in step (b) and the exterior thereof a pressure difference such that an external pressure in said assembly and said windows is greater than in internal pressure and is sufficient to deform said foil into each of said windows and form respective bosses from said foil each conforming in outline to the outline of the respective window and bulging toward said surface;

(d) applying to said foil a hardenable elastic material with sufficient form rigidity upon hardening to retain the shape of said bosses, and hardening said material; and (e) thereafter relieving said pressure difference.

2. The method defined in claim 1 wherein said foil is deformed in step (c) until said bosses touch said surface.

3. The method defined in claim 1, further comprising the step of coating said surface with a shape-preserving layer preventing the formation of bulges therein under said pressure difference.

4. The method defined in claim 1 wherein the pressure difference is established in step (c) by evacuating the interior of said assembly.

5. The method defined in claim 1 wherein the sealing of said assembly is effected in step (b) by applying a coating of lesser thickness to said assembly and thereafter applying a layer of greater thickness thereto.

* * * * *